United States Patent [19]

Lakin et al.

[11] 4,391,064

[45] Jul. 5, 1983

[54] ACROBATIC TOY

[75] Inventors: Willis M. Lakin, 7879 Northway Dr., Hanover Park, Ill. 60103; Faith L. Goodman, North Bergen, N.J.; Diane L. Savoca, Howard Beach, N.Y.

[73] Assignee: Willis Lakin, Hanover Park, Ill.

[21] Appl. No.: 220,463

[22] Filed: Dec. 29, 1980

[51] Int. Cl.[3] ..... A63H 13/12

[52] U.S. Cl. ..... 46/130; 46/32; 46/59; 46/178

[58] Field of Search ..... 46/130, 147, 32, 59, 46/47, 178, 119, 116, 123

[56] References Cited

U.S. PATENT DOCUMENTS

| | | | |
|---|---|---|---|
| 140,883 | 7/1873 | Brower . | |
| 834,140 | 10/1906 | Kingsbury | 46/147 |
| 1,157,166 | 10/1915 | Lukstat | 46/59 X |
| 1,683,910 | 9/1928 | Minnix | 46/119 X |
| 2,256,666 | 9/1941 | Chojmik . | |
| 2,514,134 | 7/1950 | Mann | 46/32 UX |

FOREIGN PATENT DOCUMENTS

| | | | |
|---|---|---|---|
| 16735 | 4/1913 | France . | |
| 450285 | 4/1913 | France . | |
| 212224 | 11/1940 | Switzerland | 46/130 |
| 732401 | 6/1955 | United Kingdom . | |
| 765721 | 1/1957 | United Kingdom . | |

*Primary Examiner*—Mickey Yu

*Attorney, Agent, or Firm*—Brumbaugh, Graves, Donohue & Raymond

[57] ABSTRACT

A toy for use in particular in a child's crib or playpen comprises a figure suspended from a rotatable main shaft in order to simulate acrobatic movements. The figure is suspended from the main shaft by a pair of arms which are fixed on the main shaft and pivotally connected to the body of the figure so that the body can swing freely as the arms rotate. The toy is hung from the crib, and operated by pulling a pull ring and cord. As the cord is pulled, the main shaft is driven through a ratchet gear mechanism. Upon release of the ring, a spring rewinds the cord, but the ratchet gear mechanism releases the positive engagement of the drive gear. The drive mechanism is preferably contained on a single drive shaft to engage directly a drive gear on the main shaft, providing a compact, durable and reliable drive network.

3 Claims, 2 Drawing Figures

ACROBATIC TOY

BACKGROUND OF THE INVENTION

The present invention is an acrobatic toy for use in particular in a child's crib or playpen.

Few sights so fascinate the young mind as the gyrations of acrobatics or trapeze artists. The curious interplay of gravity and motive force during the swinging of a gymnast often produce novel and complex aerial movements.

In acrobatic toys, since the toy figure is not normally powered to provide its own motive force, commonly the trapezist is suspended from a rotatable bar, and a mechanism is provided to rotate the bar in order to simulate acrobatic motion.

British Pat. No. 765,721 discloses a mechanical trapezist in which a clown-like figure is suspended from a horizontal trapeze bar. Through a series of gears and pulleys, the force of a hand crank or motor simultaneously swings and rotates the trapeze bar and thus the toy figure to impart trapeze-like motion. The hand crank may be operatively connected to the pulley mechanism by a clutch such that when the crank handle is released the figure can continue to swing.

British Pat. No. 732,401 discloses an acrobatic type of toy. The toy acrobat pivots freely about its arms, and the other ends of the arms are fixed to a rotating shaft. A crank and pulley mechanism rotates the shaft to impart acrobatic-like movement.

While such toys produce acrobatic and trapeze-like movements, they are unsuitable for use with very young children. In the case of children who are still in the crib age, a toy must be simple to operate, rugged, have few and simple moving parts, and a minimum of stress points across any motion transfer mechanisms which could cause binding. Thus, the crank handle mechanism of the above-described patents are not particularly simple for a young child to operate. Moreover, the pulley mechanisms are susceptible of slippage, and the compound gear mechanisms of the '721 British patent may be susceptible to binding or breakage.

SUMMARY OF THE INVENTION

The present invention is an acrobatic toy designed for very young children which may be used inside a crib or playpen, and in which the child can impart complex acrobatic movements to the toy figure by easily grabbing and pulling down on a spring-wound pull ring. In addition to the simplicity of operation, motion is imparted through a gear mechanism having only several moving parts on a single drive shaft such that tugging action on the pull ring, which will impart the driving force, produces a minimum of stress points across the motion transfer mechansim which could cause binding or bending moment on the gears or shafts. Accordingly, the toy is inherently rugged and reliable.

More particularly, the present invention provides a crib or playpen toy having an acrobatic figure suspended from a rotatable shaft. The figure is suspended from the shaft by a pair of arms which are pivotally connected to a second shaft which passes through the figure. In the preferred embodiment, the improved toy has an easily graspable pull ring which, together with an attached cord, actuates the movement of the rotatable shaft causing the arms of the figure to rotate. As a result of the pulling action, the figure swings about in a circular rotation and, simultaneously due to gravity, rotates about the second shaft to simulate acrobatic movement. The toy has a pair of eyelets which permit the toy to be hung from a child's crib or playpen. The figure in the toy is preferably one with a pleasant, entertaining appearance, such as a clown.

The present invention offers significant advantages over acrobatic toys of this nature which have been developed to date. Since eyelets are provided, the toy can be suspended from the child's crib or playpen in a position which is above the area where the child normally sits, lies, crawls or stands. The pull ring actuating mechanism enables the child to merely grasp the ring and tug in order to cause the figure to simulate acrobatic movement.

Moreover, the arrangement of the present invention provides that when the pull ring is released, the cord to which the ring is attached rewinds. Thus, the present invention affords a child with the opportunity of being continuously amused since all that is required is that the child tug and release the ring in order to cause the figure to simulate acrobatic movement.

DESCRIPTION OF EXEMPLARY EMBODIMENT

Figure 1:
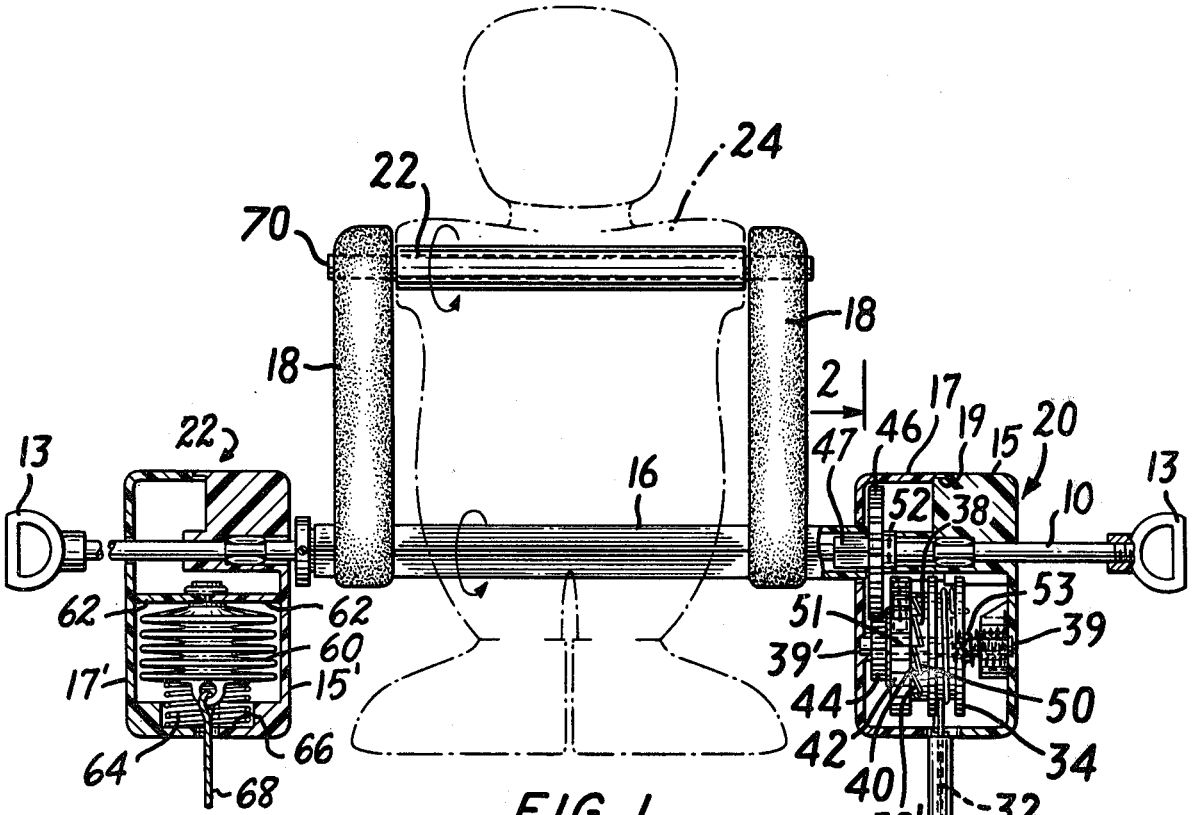
FIG. 1 is a front view of the acrobatic toy comprising the present invention.
Figure 2:
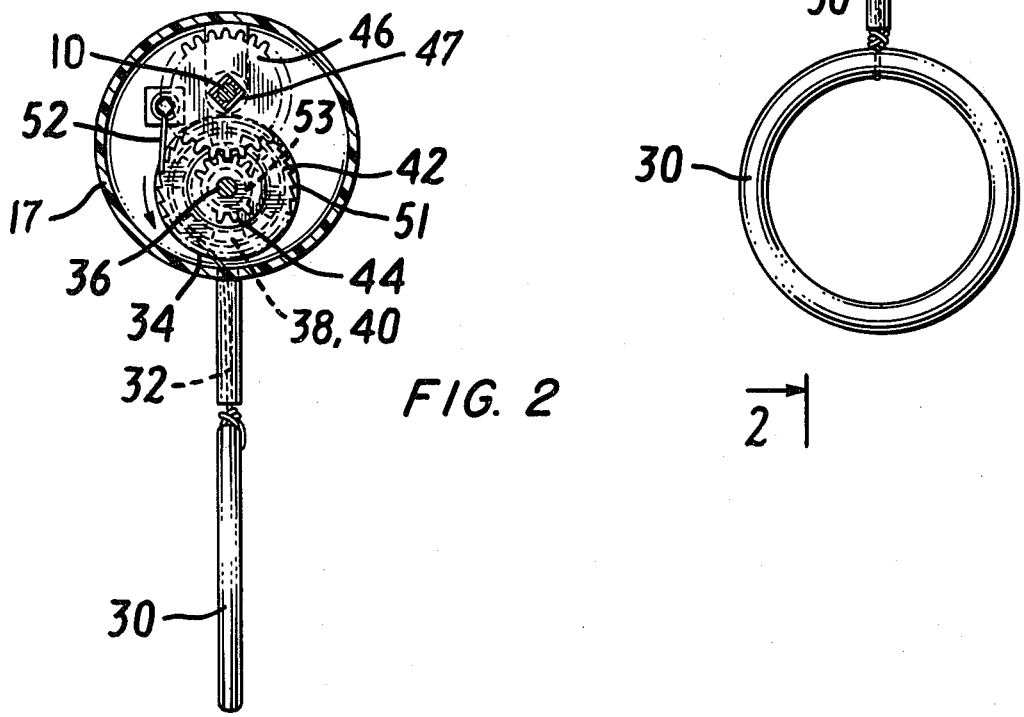
FIG. 2 is a side sectional view through line 2—2 of FIG. 1.

In the drawings, the toy comprises a steel rod 10 which acts as a cross bar that supports gear housing 20 at one end of the rod 10 and a squeeker housing 22 at the other end of the rod 10. An eyelet 13 is attached to each end of the rod 10 so that the toy can be hung from a child's crib or playpen with the housings 20 and 22 swinging freely. The gear housing 20 includes a male cup portion 15 that interfits with the rod 10 and a female cup-shaped cover 17 which fits securely onto a rim 19 in the male cup 15.

The squeeker housing 22 is similar to gear housing 20, and includes a pair of cup-shaped cooperating housing halves 15', 17'. The housing half 15' interfits with the rod 10 to be supported by the rod 10. A squeeker 60 is clamped between a pair of bosses 62 on the housing halves 15', 17', to be supported by the housing 22. A spring 64 is arranged between the squeeker 60 and the housing 22 and is positioned in a spring seat 66 formed in the lower portions of the housing halves 15', 17'. A pull cord 68 extends through a hole in the bottom of the housing 22 for actuating the squeeker against the force of the return spring 64.

A hollow main shaft 16 is disposed around and rotatable about the fixed cross bar 10. As shown in FIG. 1, one end of the hollow shaft 16 fits over and is supported by a bearing sleeve which is a tubular extension 47 of a driving gear 46 for rotation therewith. The gear 46 and extension 47 are similarly rotatable about the cross bar 10, and the outer surface of the extension 47 may be square in cross-section to interlock with the shaft 16. A tubular bearing sleeve 49, disposed around and rotatable about the cross bar 10, supports the other end of the main shaft 16.

The shaft 16 passes through the respective ends of a pair of arms 18, which arms are non-rotatable relative to the shaft and hence rotate as the shaft is rotated by the driving gear 46. A pivot shaft 70 extends through a pair of aligned holes in the other ends of the arms 18 and also through a tube 22 in a figure 4 which thus is free to swing about the pivot shaft 70. The figure 24 is preferably one with a pleasant, entertaining appearance, such as a clown.

The main shaft 16 is rotated by means of a pull ring 30 attached to one end of a cord 32, which actuates a ratchet gear mechanism. A reel 34 is attached to the other end of the cord 32. The reel 34 is located on, but not fixed on, a drive shaft 36, which may be supported in a pair of bearing blocks 39, 39' in the gear housing halves, 15 and 17 respectively. For the reasons set forth below, the reel 34 is free both to rotate about shaft 36 and to slide axially along the shaft 36.

Ratchet teeth 38 are molded on the side of the reel 34, and biased axially along shaft 36, by spring 53, into engagement with cooperating teeth 40 in a ratchet wheel 42 which is fixed on the drive shaft 36 against axial movement. When the cord 32 is pulled, the reel 34 rotates about the drive shaft 36. The ratchet teeth 38 engage the cooperating teeth 40 on the ratchet wheel 42 to rotate the wheel 42 and shaft 36. A small output gear 44 is attached to the wheel 42 or fixed on the shaft 36 such that the gear 44 is rotated as the ratchet wheel 42 is rotated. The small gear 44 engages the large driving gear 46 fixed to the main shaft 16, thereby rotating the main shaft.

The spring 53, in addition to loading the reel 34 axially, acts as a restoring spring for the cord 32 and reel 34. The spring 53 is fixed at one end to the reel 34 and at the other end to the cup 15. As the cord 32 is extended (by tugging the pull ring 30), the rotation of the pulley 34 winds the spring 53. When pull ring 30 is released, the spring 53 rewinds the reel 34 and thus the cord 32 onto the reel 34. As the reel rewinds, however, rotating in reverse direction, ratchet teeth 38 and 40 engage along planar surfaces 50 and 50'. Reel 34 is able to move axially away from ratchet wheel 42, and slippage rather than positive engagement occurs between the teeth 38 and 40. As a result, the ratchet wheel 42, the smaller gear 44, the shaft 36, the large gear 46 and the main shaft 16 remain stationary. A pawl 52 may also be fixed with respect to a boss protruding from the cup 15 to engage serrations 51 on the outer rim of ratchet wheel 42 to insure against reverse rotation.

The rotation of the main shaft 16 occurs only during the downward pulling movement of the ring 30 and this rotation causes the arms 18 to rotate. With the rotation of the arms 18, the figure 24 swings about in a circular rotation and, simultaneously, due to gravity, rotates about pivot shaft 70 to simulate acrobatic movement.

The invention has been shown with reference to a preferred embodiment thereof. Variations and modifications of the invention will be apparent to persons skilled in the art without departing from the inventive concepts disclosed herein. For example, while in the illustrated embodiment the main support for the housings 20, 22 and toy mechanism 15 is provided by the cross bar 10, the cross bar may be eliminated and the housings 20, 22 may instead be supported by a frame. The supported housings would in turn support, via bearing surfaces on the spaced housings, the main shaft 16. In this form of the invention, the eyelets may be mounted on the frame. All such modifications and variations are intended to be within the scope of the present invention as defined in the following claims.

We claim:

1. A toy comprising:

(a) supporting means comprising a cross bar and a pair of eyelets on the respective ends of said cross bar wherein a pair of spaced bearing sleeves is on and rotatable about said cross bar;

(b) a hollow main shaft, disposed around, rotatably supported by said supporting means at spaced locations along said main shaft;

(c) a figure suspended on said main shaft, wherein said figure comprises a body and a pair of arms, said pair of arms being fixedly attached at their respective one ends to said main shaft and pivotally mounted to said body at their respective other ends;

(d) driving means for rotating said main shaft about its axis, said means comprising a cord wound about a reel, a ratchet gear means arranged between said reel and said main shaft, wherein the gears of said ratchet gear means positively engage for driving said main shaft when said cord is pulled and thereby unwound from the reel, and wherein said gears slip as the cord is rewound onto the reel so as not to drive said main shaft;

(e) biasing means for rewinding the cord onto the reel;

(f) means for suspending said supporting means and hence the toy from a crib or the like for providing counterforce to pulling action on said cord;

(g) a first and second housing supported at spaced locations by said supporting means and means for attaching said housings to said cross bar, wherein said first housing comprises a gear housing for containing said driving means;

(h) a drive shaft mounted in said gear housing, wherein said driving means is contained on said drive shaft, wherein said reel is rotatably mounted on said drive shaft and axially displaceable along said drive shaft, and wherein said driving means comprises a first ratchet gear on said reel, a second ratchet gear fixed on said drive shaft for cooperating with said first ratchet gear, a spring fixed at one end on said gear housing and at the other end to said reel for urging said first ratchet gear into engagement with said second ratchet gear, and an output gear fixed on one of said drive shaft and said second ratchet gear for driving said main shaft when said cord is pulled and said ratchet gears are in positive engagement;

(i) a drive gear coupled with said main shaft for rotation therewith and engaging said output gear wherein one of said bearing sleeves forms a part of said driving gear; and (j) a pivot shaft extending through aligned holes in said other ends of said arms and said body for rotatably mounting said body to said arms.

2. A toy as defined in claim 1, comprising a squeeker mechanism in said second housing and a pull cord attached to said squeeker mechanism and extending from said second housing for actuating said squeeker mechanism.

3. A toy as defined in claim 2, comprising pawl means fixed relative to said gear housing and engaging said second ratchet gear for preventing reverse rotation of said second ratchet gear and thereby said main shaft during rewinding of said cord.

* * * * *